US006430880B1

(12) United States Patent
Kemeny

(10) Patent No.: US 6,430,880 B1
(45) Date of Patent: Aug. 13, 2002

(54) DISPLAY PANEL WITH DEPLOYABLE VERTICAL STABILIZATION

(75) Inventor: Matthias D. Kemeny, Beaverton, OR (US)

(73) Assignee: Idea Development Company, Beaverton, OR (US)

( * ) Notice: Subject to any disclaimer, the term of this patent is extended or adjusted under 35 U.S.C. 154(b) by 0 days.

(21) Appl. No.: 09/513,366

(22) Filed: Feb. 25, 2000

(51) Int. Cl.[7] ..... E04B 7/16

(52) U.S. Cl. ..... 52/71; 52/239; 52/240; 52/243.1; 52/586.2; 52/584.1; 52/587.1; 160/135; 160/351; 160/369; 403/363

(58) Field of Search ..... 52/71, 239, 240, 52/241, 242, 243.1, 285, 586.2, 586.1, 584.1, 587.1; 403/339, 340, 363; 160/135, 351, 369

(56) References Cited

U.S. PATENT DOCUMENTS

| | | | | |
|---|---|---|---|---|
| 34,738 | A | | 3/1862 | Canfield |
| 88,123 | A | | 3/1869 | Boughner |
| 404,636 | A | | 4/1889 | Levy |
| 526,135 | A | | 9/1894 | Stone |
| 892,413 | A | | 7/1908 | Freeman |
| 2,187,870 | A | | 1/1940 | Veccia |
| 3,332,192 | A | | 7/1967 | Kessler et al. |
| 3,589,755 | A | | 6/1971 | King |
| 4,437,275 | A | | 3/1984 | Zeigler |
| 4,462,196 | A | | 7/1984 | Freiberg |
| 4,471,548 | A | | 9/1984 | Goudie |
| 4,512,097 | A | | 4/1985 | Zeigler |
| 4,610,560 | A | | 9/1986 | Miller |
| 4,658,560 | A | | 4/1987 | Beaulieu |
| 4,712,336 | A | | 12/1987 | Backer |
| 4,809,471 | A | | 3/1989 | Wichman et al. |
| 4,823,858 | A | | 4/1989 | Perutz |
| 4,888,895 | A | | 12/1989 | Kemeny |
| 4,942,686 | A | | 7/1990 | Kemeny |
| 4,967,531 | A | | 11/1990 | Giles et al. |
| 5,092,385 | A | * | 3/1992 | Beaulieu ..... 160/135 |
| 5,097,643 | A | | 3/1992 | Wittler |
| 5,179,810 | A | * | 1/1993 | Gename et al. ..... 52/240 |
| 5,203,126 | A | | 4/1993 | Sorenson et al. |
| 5,203,134 | A | | 4/1993 | Sorenson et al. |
| 5,211,502 | A | * | 5/1993 | Upham-Hill ..... 403/353 |
| 5,295,341 | A | | 3/1994 | Kajiwara |
| 5,325,649 | A | | 7/1994 | Kajiwara |
| 5,501,051 | A | | 3/1996 | Harlan |
| 5,546,720 | A | | 8/1996 | La Bruzza |
| 5,657,604 | A | * | 8/1997 | Malott ..... 52/655.1 |

* cited by examiner

*Primary Examiner*—Carl D. Friedman
*Assistant Examiner*—Yvonne M. Horton
(74) *Attorney, Agent, or Firm*—Kolisch Hartwell Dickinson McCormack & Heuser

(57) ABSTRACT

A modular display panel and edge latching system therefor which employs concealed movable latching mechanism that can be actuated between adjacent panels set up, for example, on a floor to lock the panels into vertical alignment and against any tendency of floor unevenness to cause adjacent panels to become misaligned vertically. The components in the latching mechanism which create vertical position locking are actuated by the insertion of actuators typically carried as downward projections on other panels which rest on top of directly floor supported, underlying panels.

11 Claims, 3 Drawing Sheets

DISPLAY PANEL WITH DEPLOYABLE VERTICAL STABILIZATION

BACKGROUND AND SUMMARY OF THE INVENTION

This invention pertains to a modular display panel system, and more particularly to a panel usable in such a system, and to a latch structure which is employed in such a panel to stabilize laterally adjacent panels against vertical misalignment of the type which can occur on an uneven floor.

There are many environments, such as those relating to trade shows, art exhibits, conventions, etc., wherein portable modular panel systems are employed to provide generally large-area continuous surfaces for displaying various things. Such systems are in relatively widespread use, and are typically installed over and over again in different settings. Such systems are, generally speaking, modularized in such a fashion that they can easily be assembled in various configurations, and easily disassembled for compact storage and convenient transportation from location to location.

An issue which often arises with respect to different display environments is that a system of the type now generally being discussed may be set up in an area where the underlying support floor is irregular, uneven, etc. In such a situation, it can occur, and too often does occur, that laterally adjacent panels in an assembled display panel system become vertically misaligned as a consequence of underlying floor irregularity. Such misalignment is unsightly, undesirable and often difficult to cure on the spot.

The present invention recognizes the desire to deal with this issue in a relatively simple and convenient manner, and proposes a unique edge-to-edge latching and stabilizing structure, incorporated at the side margins of those panels which will become laterally adjacent panels in an overall panel assembly, which structure positively latches adjacent (edge-to-edge) panels against undesirable vertical misalignment of the type mentioned. In a panel system which employs the structure of the present invention, support floor unevenness of the kind above referred to does not telegraph itself into vertical panel misalignment in the assembled display.

For general background information regarding the field of this invention, reference is here made to several U.S. Patents. Particularly, reference is made to U.S. Pat. No. 4,437,275 (to Zeigler), U.S. Pat. No. 4,471,548 (to Goudie), U.S. Pat. No. 4,512,097 (to Zeigler), U.S. Pat. No. 4,712,336 (to Backer), U.S. Pat. No. 4,610,560 (to Miller), U.S. Pat. No. 4,823,858 (to Perutz) and U.S. Pat. No. 5,546,720 (to LaBruzza).

According to a preferred embodiment of the present invention, the same includes, for each panel with respect to which it is employed, and further with respect to each lateral edge of such a panel which is intended to join with a lateral edge of an adjacent panel, an elongate generally upright channel structure which carries certain interactive latching components made in accordance with the invention. The proposed channel structure includes (1) an elongate channel member having an elongate, nominally open-ended channel, and (2) an elongate, laterally outwardly facing exposure slot which opens to one lateral side of the channel.

Disposed within the channel, preferably adjacent the upper open end thereof, and nominally concealed inside the channel, is a hinged, spring-biased coupler which is yieldably urged by an appropriate biasing spring toward a condition in which it is substantially entirely concealed and contained within its associated channel. The coupler can be swung (actuated) against the yieldable resistance provided by the biasing spring toward a deployed condition, wherein an end, somewhat claw-like, coupling portion in the coupler extends laterally outwardly through the exposure slot associated with the channel. During operation of the system, this extended coupling portion overlaps, and latches with, a like deployed coupling portion in a coupler associated with an adjacent panel. Such latching stabilizes the two, laterally adjacent panels against unwanted vertical misalignment.

Actuation of laterally adjacent couplers to swing their coupling portions into deployed conditions is performed (in accordance with the invention) through vertical introduction and positioning of elongate actuators, or actuator structures, into the upper open ends of the associated channels. Such positioning causes the introduced actuators and the associated couplers to engage one another in a kind of "camming" manner which causes swinging of the associated couplers to place their coupling portions in the mentioned deployed conditions.

Preferably, the actuator of this invention takes the form of a channel-mountable element which, when appropriately affixed in a channel, extends downwardly from the lower end of the channel in a panel member that is to be stacked on top of another panel member. When a panel having this actuator is mounted on top of another panel, the extending part of the actuator enters the open upper end of the underlying channel in the underlying panel. The extending element engages and actuates the coupler provided in that underlying panel, and, by causing rotation of the coupler against the action of the associated biasing spring, shifts the coupler's coupling portion to the above-mentioned deployed condition.

Alternative embodiments of the invention disclosed herein feature modified structural components, including elongate actuator elements which, if no "stacked-panel" condition is to be created, can be inserted downwardly into the open ends of channels to produce coupler deployment. All elements and features of the modified structures are to be treated herein as being incorporated appropriately in the language presented in the claims to the invention.

Various other important features and advantages that are offered by the present invention will become more fully apparent as the description that now follows is read in conjunction with the accompanying drawings.

DETAILED DESCRIPTION OF, AND BEST MODE FOR CARRYING OUT, THE INVENTION

Figure 1:
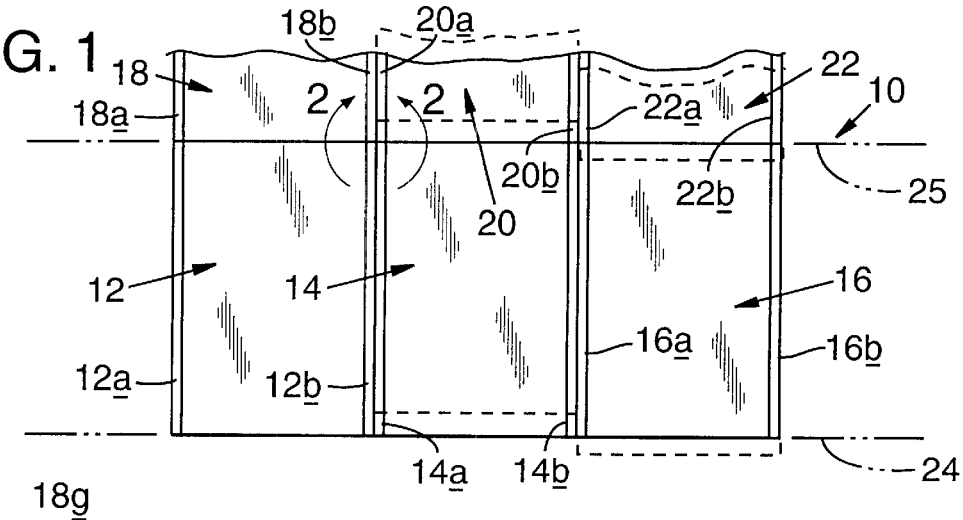
FIG. 1 is a simplified, fragmentary, front elevation illustrating a modular display panel system (portions of six panels being shown) which incorporates panels, and latch structure there in accordance with the present invention.

Turning now to the drawings, and referring first of all to FIG. 1, indicated generally at 10 is a modular display panel system including panels and latch structure which have been constructed in accordance with the present invention. Specifically pictured (in some instances fragmentarily only) in FIG. 1 are six interconnected panels, including three lower panels, 12, 14, 16, on top of which are stacked, directly and respectively, overhead panels 18, 20, 22. In general terms, these six panels are displayed resting on a floor which is represented by dash-double-dot line 24 in FIG. 1.

In FIG. 1, the panels in system 10 are shown in solid outline in conditions where they are essentially appropriately and properly vertically aligned with one another. That is to say, the upper edges of lower panels 12, 14, 16 lie substantially along a common straight line which is pictured as a horizontal dash-triple-dot line 25 in FIG. 1. Line 25 substantially parallels line 24.

This condition of vertical alignment is the desired condition for the panels in system 10, and such an alignment is always easily achieved where a system, such as system 10, is set up on a floor which is itself substantially flat, planar and even. However, and in the absence of structure like that proposed by the present invention, such vertical alignment may frequently not be the case - such being dictated principally by unevenness in the underlying support floor which telegraphs itself into a system's panels. Such telegraphing and unevenness cannot easily be avoided unless laterally adjacent panels in the display system are suitably anchored to one another against vertical misalignment. Such anchoring, of course, should be accomplished without detracting from the important modular, easy set-up and take-down characteristics that are normally desired for a display system such as that pictured in FIG. 1.

In a quite exaggerated sense, one condition of undesirable vertical misalignment between laterally adjacent panels is also pictured in FIG. 1, specifically with respect to panels 14, 16, 20, 22. In particular, panel 14 and its overhead-supported panel 20 are shown in dashed lines to be elevated, and out of appropriate vertical alignment, relative to their left-hand, laterally adjacent neighbors, panels 12, 18, respectively. Similarly, panel 16 and its overhead supported panel 22 are shown in dashed lines in FIG. 1 to be out of appropriate vertical alignment, and specifically, lowered relative to their immediately adjacent neighboring panels 14, 20.

Figure 10:
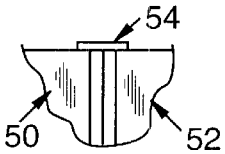
FIG. 10 is a simplified, fragmentary front elevation, on a scale which is roughly the same as that employed in FIG. 1, showing a modified form of the system of the present invention wherein an actuator capping element is employed in the place of overhead stacked panels t create vertical stabilization.

As was mentioned earlier, system 10 is one which incorporates and is employing panels and latch structure that have been constructed in accordance with the present invention. Because of this situation, and quite independently of the possible general unevenness in floor 24, all of the panels pictured in FIG. 10 are in appropriate vertical alignment relative to one another. This alignment has been positively dictated, and is controlled, by the vertical alignment and stabilization capability promoted and implemented by the invention.

One final comment should be made about lateral juxtaposition of panels, such as the panels pictured in FIG. 1. This is, that it is very typical in conventional modular display panel systems to join adjacent panels in a manner which is accomplished by vertical contiguous sliding of adjacent edges of the panels relative to one another so as to connect them through lateral attachment clips. Such clips conveniently and confidently hold panels laterally next to one another, but, because of their very nature which requires sliding movement to create engagement and disengagement, they do not prevent the kind of vertical misalignment pictured in FIG. 1.

Still with reference especially to FIG. 1, each of the six panels pictured in this figure includes a rectangular panel body, and is furnished, according to the invention, with sets (pairs) of laterally spaced, edge-disposed, elongate, upright channel members which form part of the present invention. The channel members are attached to the laterally opposite sides of the associated panel bodies. With regard to panels 12, 14, 16, 18, 20, 22, these respective sets of channel members are pictured at the left and right sides, respectively, of the six panels at 12*a*, 12*b*, 14*a*, 14*b*, 16*a*, 16*b*, 18*a*, 18*b*, 20*a* 20*b*, and 22*a*, 22*b*, respectively.

Figure 2A:
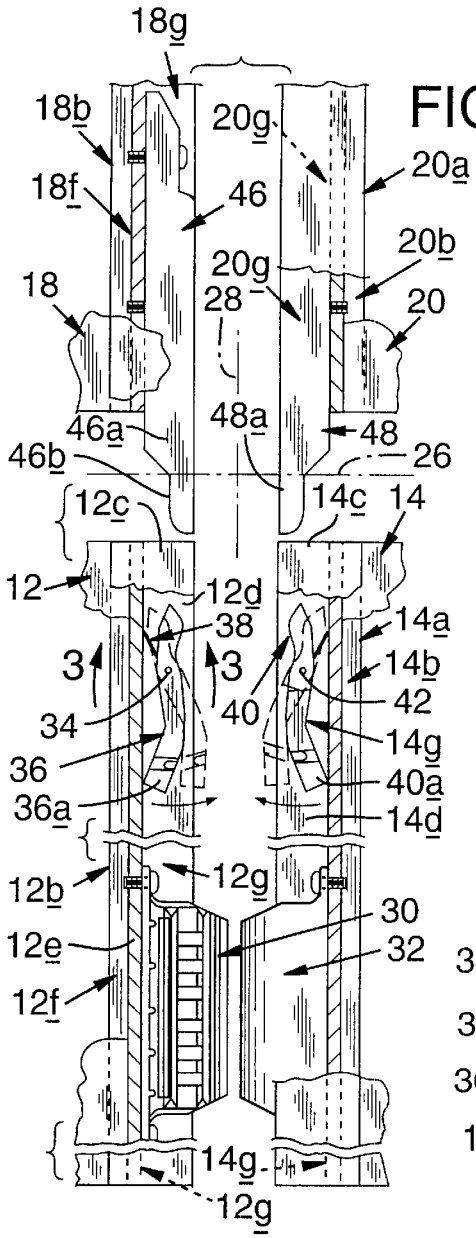
FIGS. 2A, 2B and 2C are larger-scale fragmentary views, taken generally in the U area of FIG. 1 which is embraced by the two curved arrows marked 2—2 in that figure. These views show three different relative positionings of four of the six panels pictured in FIG. 1. In these 2A, 2B and 2C views, certain portions have been broken away to illustrate details of coupler and actuator structure that collectively form cooperative portions of the present invention.

Focusing attention now on FIGS. 2A-9, inclusive, along with FIG. 1, and aiming discussion first of all particularly at FIG. 2A, here, panels 12, 14, 18, 22 are shown vertically and laterally separated from one another in conditions which might exist just prior to their being assembled in system 10.

Thus, the lower two panels, 12, 14, and the overhead, upper two panels 18, 20, are shown spaced apart below and above, respectively, a dash-dot horizontal line 26. Similarly, the left and right pairs of panels, 12, 18 and 14, 20, respectively, are shown spaced apart, to the left and to the right, respectively, of a vertical dash-dot line 28 in FIG. 2A.

All of the channel members in the panels in system 10 are substantially the same in construction, and four of these channel members 12*b*, 14*a*, 18*b* and 20*a* are labeled specifically in FIGS. 2A-9. Initially, detailed reference will be made specifically to channel members 12*b* and 18*b* and to their "contents", with the understanding that the specific structures and contents of all of the other channel members are essentially the same. Similar reference characters are employed, and are discussed in some case without specific pre-introductions of these characters, to designate like regions and contents of the other channel members.

Describing the specific construction of channel member 12*b*, this member includes spaced, front and rear substantially parallel plates 12*c*, 12!1 respectively. Plates 12*c*, 12*d* are spanned, and spaced apart, by a connecting plate 12*e* which lies in a plane that is normal to the planes of FIGS. 2A, 2B and 2C. Channel member 12*b* also includes inwardly and outwardly facing channels 12*f* and 12*g*, respectively. Digressing for a moment to refer to FIG. 9, here one can see that the channel members, such as members 12*b*, 14*a*, have somewhat H-shaped cross-sectional configurations. While the presence in the channel members of outwardly facing channels, like channel 12*g*, is important the embodiment of the invention now being described, an H-shaped cross section is not a requirement.

Inwardly facing channel 12*f* receives, in any suitable fastened manner, the right edge of the previously-mentioned panel body in panel 12. Channel 12*g* is an outwardly facing channel, outwardly facing with respect to the lateral (right) side of panel 12 in the figures, which channel effectively defines an open exposure slot that exposes he interior of the channel. In other words, with panel 12 unconnected to panel 14, the interior of laterally facing channel 12*g* is fully exposed through this elongate exposure slot. The upper and lower (base) ends of channel 12*g* are pictured in FIG. 2A, and one can see in this figure that these two channel ends are essentially open.

Suitably anchored, as by bolting, to the inside of channel 12*g*. intermediate the opposite ends of that channel, and at suitable, chosen locations, are clips, such as clip 30, which are employed, as will now be explained, in a conventional manner with one or more other like clips, to fasten the right edge of panel 12 to the left edge of panel 14. These clips fasten these two edges in a sense which locks them against lateral separation.

Shown at 32 in FIG. 2A is a matching, though reversely-positioned, clip which is appropriately provided at the correct location in, and along-the length of, channel 14*g* in channel member 14*a*. With panels 12, 14 appropriately disposed next to each other, clip 32 connects with clip 30 to effect the kind of lateral joinder just mentioned. Previously-mentioned prior art U.S. Pat. No. 5,546,720 specifically discloses the clip construction illustrated for clips 30, 32. The '720 patent is hereby incorporated herein by reference.

Figure 2B:
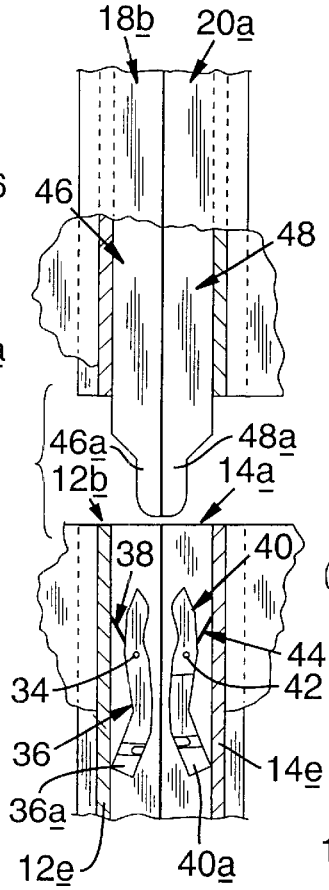
Figure 2C:
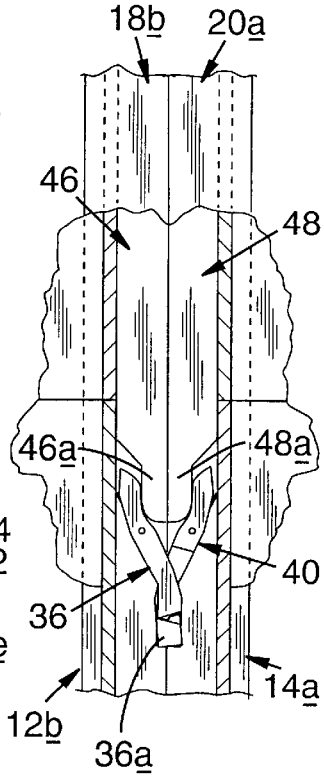
Figure 3:
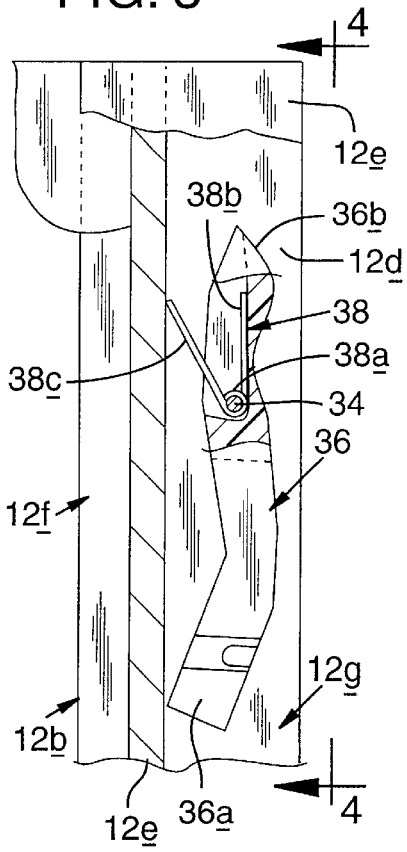
FIG. 3 is an even larger-scale fragmentary view, taken generally in the area in FIG. 2A embraced by the two curved arrows which are marked 3—3. This view further illustrates the construction of a hinged/pivoted coupler structure made in accordance with the present invention.
Figure 4:
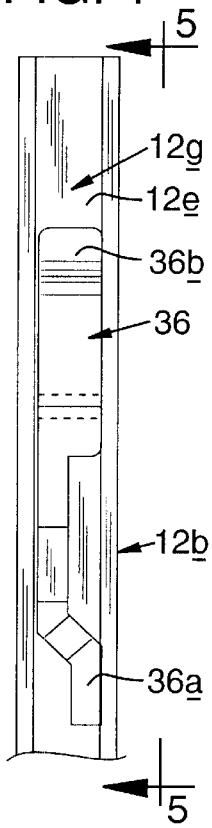
FIG. 4 is like a scale fragmentary view, taken generally along the line 4—4 in FIG. 3.
Figure 5:
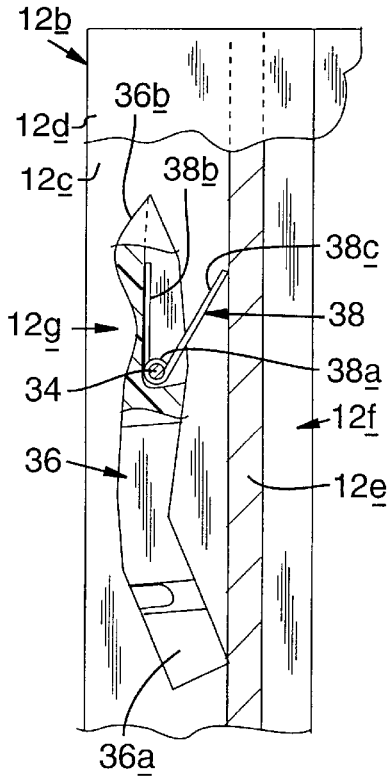
FIG. 5 is a fragmentary view, on about the same scale as that employed in FIGS. 3 and 4, taken generally along the line 5—5 in FIG. 4.

When, for example, panels 12, 14 are brought together laterally for joinder utilizing clips, such as clips 30, 32, the panels are vertically offset from one another in order to permit the otherwise laterally confronting clips to be offset vertically relative to one another, thus to permit vertical sliding engagement which will cause the clips to connect the two panels in the manner suggested above. FIGS. 2B and 2C show the relative lateral positions which exist between panels 12, 14 and panels 18, 20, respectively, when such a lateral connection has been made.

Returning to what is shown in FIG. 2A, and jumping a little bit ahead in the story describing the present invention, it should be noted that, as was briefly mentioned above, the lower end of channel 12*g* is open, and contains no protruding structure. This is the case in order to permit panel 12 to be seated easily and directly on a floor, such as on floor 24 in FIG. 1. Such also is true with respect to the lower end of channel 14*g* in channel member 14*a*. Further, this same condition exists regarding the lower ends of the channels in the other channel members that form parts of panels that contact floor 24. Other panels in system 10, as will soon be discussed, include downwardly protruding actuators that function as part of the latching structure of the invention.

Figure 6:
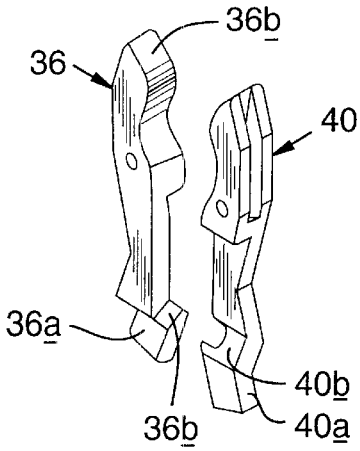
FIG. 6 is a perspective view, presented on a drawing scale which is intermediate those scales employed, respectively, for FIGS. 2A, 3, 4 and 5, illustrating, in an isolated fashion, two identical couplers made in accordance with the present invention. These couplers are releasably latchable with one another in accordance with operation of the system of the present invention.

Mounted on a hinge, or pivot, pin 34 which extends between channel plates 12*c*, 12*d*, generally near the upper open end of channel 12*g* is a movable (swingable) coupler 36 formed in accordance with the present invention. Coupler 36, whose configuration in perspective is shown in FIG. 6, includes a lower, somewhat clasp- or claw-like coupling portion 36*a*, the operation of which will be described shortly. This portion includes a notched area 36*b* (see particularly FIG. 6). In solid outline in FIGS. 2A 2B, 3, 4, 5 and 7, coupler 36 is shown in a position within the interior of channel 12*g* to which it is normally biased yieldably by an appropriate biasing spring 38. Spring 38 includes a coil portion 38*a* (see FIGS. 3 and 5) that circumsurrounds pin 34, and a pair of spring arms 38*b* 38*c* which act between the upper end of coupler 36 and plate 12*e*. Spring 38 yieldably biases and urges coupler 36 into the position in which it is shown in solid outline, in which position the entirety of the coupler is essentially hidden or concealed (in relation to front and rear views of panel 12) within channel member 12*b*.

In dashed outline in FIG. 2A, coupler 36 is shown in what is referred to herein as a deployed condition wherein its coupling portion 36*a* extends outwardly beyond the right side of the exposure slot in channel 12*g*. As will be explained, it is in this deployed condition of the coupler and its coupling portion that the coupling portion can latch with a companion coupling portion provided in a laterally adjacent panel, thus to secure such two panels against vertical movement relative to one another, and hence to stabilize them against vertical misalignment.

Similarly mounted within channel 14*g* in channel member 14*a* is a coupler 40 which is exactly the same in construction as just-described coupler 36. Coupler 40 includes a lower-end coupling portion 40*a* which is like previously mentioned coupling portion 36*a*, and coupler 40 is pivoted for movement, as in the case of coupler 36, through a hinge, or pivot, pin 42 which extends between plates 14*c*, 14*d* in channel member 14*a*. Portion 40*a* includes a notched region 40*b*. (See particularly FIG. 6). A biasing spring 44, which is like previously mentioned biasing spring 38, acts in a manner similar to that described for spring 38, between coupler 40 and plate 14*e* in channel member 14.

Figure 7:
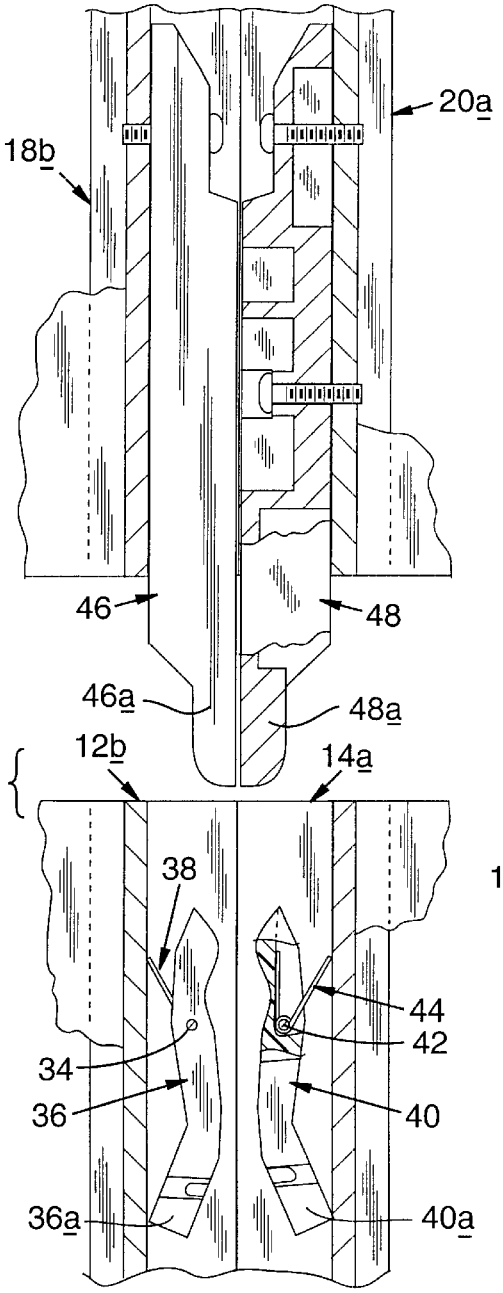
FIG. 7 is a view which is very much like that presented in FIG. 2B, showing, on a much larger scale, coupler and actuator components made in accordance with the present invention. Here, these components are illustrated in a condition where a pair of upper panels in the display system pictured in FIG. 1 are about to be lowered onto a pair of lower panels in that system.
Figure 8:
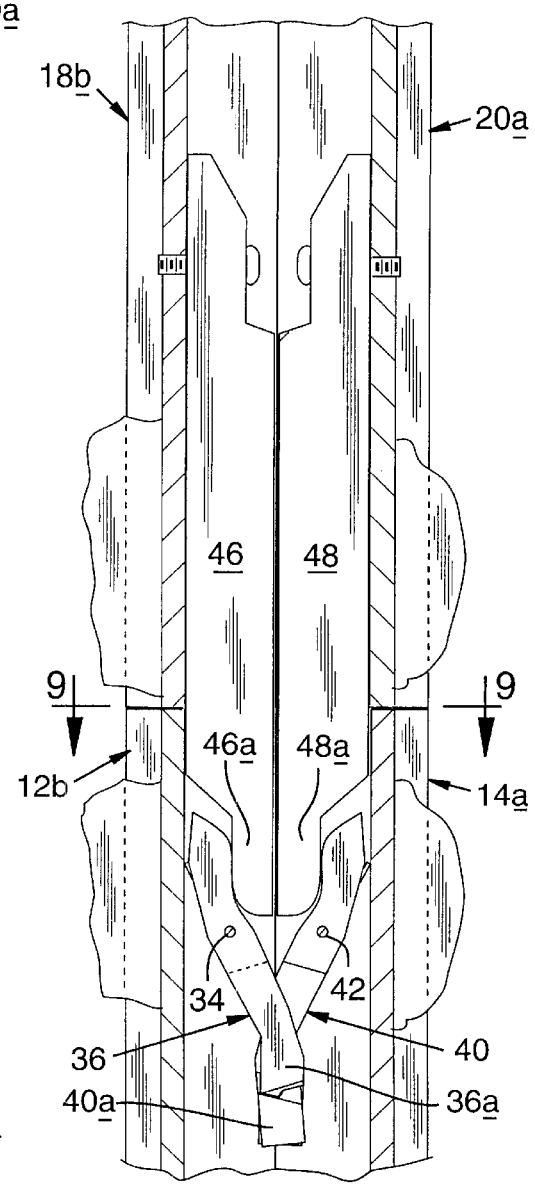
FIG. 8 is very much like FIG. 2C, is drawn on about the same scale as that employed in FIG. 7, and illustrates a condition where the upper and lower panels just mentioned in the description of FIG. 7 have been brought into vertical engagement. In this illustrated condition, the two hinged couplers which are pictured have latched to provide vertical positional stability between the two illustrated pairs of laterally adjacent panels.
Figure 9:
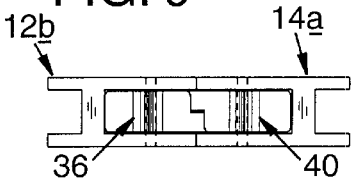
FIG. 9 is a view taken generally along the line 9—9 in FIG. 8, showing the condition of "overlapping" latching engagement which exists between the coupler portions in the two couplers pictured in FIGS. 8 and 9. Such overlap exists essentially along a line (the dash-dot line presented in FIG. 8) which generally parallels the two long axes of the channels containing these two couplers. This dash-dot line in FIG. 8 is substantially normal to the plane of FIG. 9. Portions of actuators have been omitted from this view in order to allowing of the tops of the couplers.

In solid outline in FIGS. 2A, 2B and 7 coupler 40 is shown in a non-deployed condition substantially entirely within the confines of channel 14*g*. In dashed outline in FIG. 2A, coupler 40 is shown in the same kind of deployed condition mentioned above for coupler 36.

Completing a description of the latch mechanism of the present invention, suitably anchored, as by bolting, into the lower end of channel 18*g* in channel member 18*b*, directly overhead channel member 12*b*, is an elongate actuator 46 having the shape generally shown. The lower end 46*a* in actuator 46 protrudes downwardly from the bottom end of channel 18*g*, and includes a region 46*b* which functions, as will be explained, as a cam surface with respect to actuation of an underlying coupler such as underlying coupler 36. Referring for a moment specifically to FIGS. 3, 4, 5 and 6, a co-acting cam surface in coupler 36 is shown here generally at 36*b*.

A similar actuator 48, with a construction which is substantially identical to that just described for actuator 46, is secured in the lower end of channel 20*g* in channel member 20*a*.

During the procedure to set up panels such as the panels pictured in system 10 in FIG. 1, at appropriate times, laterally adjacent panels are brought next to one another, slightly vertically offset, and slid relatively vertically in order to latch them laterally through clips such as clips 30, 32. Typically, the lower array of panels, such as panels 12, 14, 16, will be so assembled, and placed appropriately on a floor, such as floor 24. Next, the overhead panels are assembled with the underlying panels, either by placing these overhead panels one-by-one on top of an immediately underlying panel, or by joining adjacent ones of these panels, and perhaps lowering them in pairs onto appropriate pairs of underlying panels. Lateral latching of the overhead panels takes place in the manner just described for the lower panels, with clips, such as clips 30, 32 functioning to provide lateral anchoring between adjacent panels.

As an overhead panel is lowered onto an underlying panel, the actuators which project from the lower ends of the channels in the channel members move downwardly into the upper open ends of the confronting channels in the underlying channel members. The cam surfaces on these actuators engaging the cam surfaces on the immediate underlying couplers, and such engagement causes the notched, claw-like couplers to swing toward their deployed conditions against the yieldable biasing provided by the described biasing springs. Such deployment action causes the coupling portions of confronting couplers to pass and overlap one another in a kind of hand-clasp fashion. When this takes place, the couplers with their coupling portions effectively latch the associated panels with vertical stability against any appreciable vertical misalignment.

None of the structure employed to effect vertical stabilization latching is exposed or evidence, and thus, in no way detracts from the desired display appearance of the associated panels.

When it is time to disassemble a system such as system 10, simple vertical removal of overhead panels, with attendant retraction of the projecting portions of the actuators from the underlying channels, allows the previously deployed stabilization couplers to return (under the influence of their respective associated biasing springs) toward non-deployed conditions within their respective associated channel members. The previously engaged coupling portions in adjacent couplers uncouple from one another, and the associated panels are then free for relative vertical shifting to disconnect the laterally connecting clips such as clips 30, 32.

Figure 11:
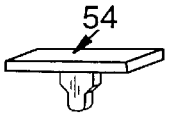
FIG. 11 is a simplified perspective view, on a somewhat larger scale than that used in FIG. 10, showing, in an isolated fashion, the capping element employed in the setting of FIG. 10.
Figure 12:
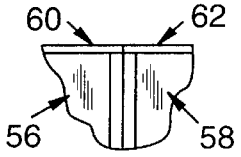
FIG. 12, which is on about the same scale of drawing as that used in FIG. 10, shows another modified form of the system of the present invention - one which also is usable in a display panel system not having vertically stacked panels.

In the case of a display panel installation wherein only a single level, or layer, of panels is intended to be used, a modified form of the invention, such as the forms shown in FIGS. 10, 11 and 12, can be used to accomplish vertical stabilization of these panels without requiring that there be any overhead panels. Specifically, and referring first of all to FIGS. 10 and 11, two adjacent panels, such as the two panels shown in FIG. 10 at 50, 52, can be vertically latched and stabilized through employing an actuator having the shape pictured at 54 in FIGS. 10 and 11. This small structure can be seated overhead the junctions of the adjacent channels in adjacent panels to actuate latching couplers, such as couplers 36, 40.

In FIG. 12, two adjacent panels are shown at 56, 58, which panels form part of a single-layer panel display system. Resting overhead these panels are two elongate capping strips 60, 62, respectively, each of which carries, adjacent its opposite ends, downwardly projecting (not specifically illustrated) actuators like previously described actuators (or at least the lower portions of these actuators) 46, 48.

Other variations embodying the structural features, and the operational capability, of the embodiments of the system so far described are certainly possible, and come well within the scope of the present invention.

While the invention has been disclosed in its preferred form, the specific if embodiments thereof as disclosed and illustrated herein are not to be considered in a limiting sense as numerous variations are possible. Applicant regards the subject matter of his invention to include all novel and non-obvious combinations and subcombinations of the various elements, features, functions and/or properties disclosed herein. No single feature, function, element or property of the disclosed embodiments is essential. The following claims define certain combinations and subcombinations which are regarded as novel and non-obvious. Other combinations and subcombinations of features, functions, elements and/or properties may be claimed through amendment of the present claims or presentation of new claims in this or a related application. Such claims, whether they are broader, narrower or equal in scope to the original claims, are also regarded as included within the subject matter of applicant's invention.

I claim:

1. Concealed, edge-joinder, latch structure for releasably retaining edge-to-edge longitudinal alignment between a pair of laterally adjacent long edges in a pair of display panels comprising, for each edge, an elongate channel member having an elongate internal channel including (a) an elongate exposure slot extending lengthwise in the member and facing outwardly relative to an associated panel, and (b) a base end, and a spaced, open, upper end, communicating with said channel, a coupler including a coupling portion, mounted in said channel adjacent said open, upper end for reversible movement of said coupling portion relative to the channel member between a non-coupling position disposed within said channel, and a coupling position deployed outwardly beyond said exposure slot, said coupling portion, when in the coupling position, being releasably latchingly engageable with a similarly deployed coupling portion of a coupler in another, longitudinally aligned and closely edge-to-edge confronting channel member of a similarly associated panel, and an actuator, reversibly movable longitudinally into and out of said channel via the said open, upper end, operatively engageable with said coupler, and operable, during movement of the actuator longitudinally into said channel, to shift the coupling portion from said non-coupling position toward said deployed coupling position, and, with movement of the actuator longitudinally out of said channel, to permit return of the coupling portion toward the non-coupling position, said coupling portion, when latchingly engaged with the other coupling portion associated with the other coupler in said adjacent channel member, overlapping the other coupling portion wherein the two coupling portions are viewed along a line which generally parallels the long axes of the two channels containing the two couplers.

2. The structure of claim 1, wherein said coupler and said actuator include interengageable can surfaces.

3. The structure of any one of claims 1 or 2, wherein the mounting of said coupler within said channel is a pivotal mounting.

4. The structure of claims 1 or 2 which further includes a yieldable biasing structure operatively interposing said channel member and said coupler, and yieldably urging said coupling portion toward the non-coupling position.

5. The structure of claim 4, wherein said yieldable biasing structure takes the form of a spring.

6. The structure of any one of claims 1 or 2, wherein said actuator takes the form of a longitudinally projecting element mounted adjacent the base end of the elongate channel in the other channel member of said associated with another panel.

7. A panel employable in a modular display panel system wherein, with the panel system in place, laterally adjacent, generally vertically aligned panels are releasably interconnected at least along laterally adjacent, upright edges, said panel comprising a panel body having a pair of laterally spaced, elongate, upright edges, each said edge is disposed adjacent an edge in a laterally adjacent panel, an elongate channel member joined to said panel body along said edge, said channel member including an elongate internal channel having (a) an elongate, laterally outwardly facing exposure slot, and (b) a base end, and a spaced, open upper end, said slot and ends communicating with the interior of said channel, a coupler including a coupling portion, pivotally mounted within said channel adjacent said open end for reversible swinging movement of said coupling portion relative to the channel member between a non-coupling position disposed within said channel, and a coupling position deployed outwardly of said exposure slot, said coupling portion, when deployed in said coupling position, being releasably latchingly engageable with a similarly deployed coupling portion of a coupler in another, longitudinally aligned and closely edge-to-edge confronting channel member of a similarly associated panel, and an actuator, reversibly movable longitudinally into and out of said channel via said open end, operatively engageable with said coupler, and operable, during movement of the actuator longitudinally into said channel, to shift the coupling portion from the non-coupling position toward the deployed coupling position, and, with movement of the actuator longitudinally out of said channel, to permit return of said coupling portion toward the non-coupling position, said coupling portion, when latchingly engaged with the other coupling portion associated the other coupler in said adjacent channel member, overlapping that other coupling portion wherein the two coupling portions are viewed along a line which generally parallels the long axes of the two channels containing the two couplers.

8. The structure of claim 7, wherein said coupler and said actuator include interengageable cam surfaces.

9. The structure of any one of claims 7 or 8 which further includes a yieldable biasing structure operatively interposing said channel member and said coupler, and yieldably urging said coupling portion toward said non-coupling position.

10. The structure of claim 9, wherein said yieldable biasing structure takes the form of a spring.

11. The structure of any one of claims 7 or 8, wherein said actuator takes the form of a longitudinally projecting element mounted adjacent the base end of the elongate channel in the other channel member of said associated with another panel.

* * * * *